US006578296B2

(12) United States Patent
Kimoto et al.

(10) Patent No.: US 6,578,296 B2
(45) Date of Patent: Jun. 17, 2003

(54) HYDRAULICALLY DRIVEN TYPE WORKING MACHINE

(75) Inventors: Kenzo Kimoto, Hirakata (JP); Masatake Tamaru, Tatsunokuchi-machi (JP); Masami Naruse, Hirakata (JP); Sadao Nunotani, Oyama (JP); Jun Maruyama, Oyama (JP); Kenji Kanemaru, Koriyama (JP); Tatsuya Futami, Koriyama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/994,750

(22) Filed: Nov. 28, 2001

(65) Prior Publication Data

US 2002/0062587 A1 May 30, 2002

(30) Foreign Application Priority Data

Nov. 29, 2000 (JP) ..... 2000-362555
May 2, 2001 (JP) ..... 2001-134851

(51) Int. Cl.[7] ..... E02F 3/36; E02F 9/00
(52) U.S. Cl. ..... 37/443; 37/466; 414/694
(58) Field of Search ..... 37/466, 403, 417, 37/443, 410, 903; 701/50; 414/694, 680

(56) References Cited

U.S. PATENT DOCUMENTS 6,266,901 B1 * 7/2001 Kanda et al. ..... 37/403

FOREIGN PATENT DOCUMENTS

JP 8-4711 1/1996

* cited by examiner

*Primary Examiner*—Christopher J. Novosad
(74) *Attorney, Agent, or Firm*—Armstrong, Westerman & Hattori, LLP.

(57) ABSTRACT

A hydraulic pipe arrangement of a working machine is not in contact with an obstacle and no torsion and no bending are generated. Accordingly, in a hydraulically driven type working machine provided with a boom (1) having a vertical swing supporting point supported at a base end side by a machine frame and a joint connection supporting point in a front end side, an arm (2) connected in a base end side to the joint connection supporting point, a boom driving hydraulic cylinder (6a) hoisting around a hoist supporting point provided in the machine frame so as to drive the boom, an arm driving hydraulic cylinder (7), and a working tool driving hydraulic cylinder (8), a swivel joint mechanism relaying a hydraulic pipe arrangement from a side of the machine frame is provided at a center of at least one of the vertical swing supporting point, the joint connection supporting point and the boom driving hydraulic cylinder hoist supporting point.

9 Claims, 10 Drawing Sheets

HYDRAULICALLY DRIVEN TYPE WORKING MACHINE

FIELD OF THE INVENTION

The present invention relates to a hydraulically driven type working machine, and more particularly to a hydraulic pipe arrangement mechanism of a hydraulically driven excavation working machine equipped in construction machinery.

BACKGROUND OF THE INVENTION

A hydraulically driven excavation working machine equipped in construction machinary such as an excavator or the like is structured such that members such as a boom, an arm, a bucket and the like are connected in series in accordance with this order from a machine main body so as to freely bend with each other. In order to supply an oil pressure to a hydraulic actuator for operating these members, there is used a hydraulic pipe arrangement apparatus for arranging a hydraulic hose from a side of a machine frame along outer portions or inner portions of the boom and the arm.

However, the conventional hydraulic pipe arrangement apparatus mentioned above has the following problems.

If it is desired to insert the hydraulic pipe arrangement in the side of the machine frame into the inner portion of the boom from a base portion of the boom over a boom hoisting supporting point pin or to insert the hydraulic pipe arrangement installed within the boom into the inner portion of the arm over a joint connection supporting point pin of the arm, it is impossible to apply a slack to the hydraulic pipe arrangement in the portion over the supporting point pins. Accordingly, due to a hoisting swing motion of the boom and a bending swing motion of the arm, the hydraulic pipe arrangement is in contact with the boom hoisting supporting point pin or the joint connection supporting point pin of the arm so as to be bent, thereby damaging the hydraulic pipe arrangement. Accordingly, the structure has been conventionally made such that these hydraulic pipe arrangements have been executed so as to extend along the outer portions of the boom and the arm, or a hole is provided in a wall of the boom and the hydraulic pipe arrangements are inserted into the inner portion of the boom, so that it has been hard to execute the hydraulic pipe arrangements in the inner portions of the boom and the arm without exposing them to the outer portion of the boom and the arm.

Further, in the hydraulic pipe arrangement to a hydraulic actuator for driving a boom hoisting operation, the actuator swings tilting in a longitudinal direction. Accordingly, a slack is provided in the hydraulic pipe arrangement extended to the actuator from the side of the machine frame, and it is impossible to extend to the actuator from the side of the machine frame without slacking the hydraulic pipe arrangement.

Further, the hydraulic pipe arrangements connected to the hydraulic actuator for driving the boom hoisting operation, the hydraulic actuator for driving the arm bending operation and the hydraulic actuator for driving a working tool are all provided with pipe arrangement connecting devices exposing to the outer portions of these actuators, and it is hard to execute the hydraulic pipe arrangements so that the hydraulic pipe arrangements of the respective actuators are not seen from an outer appearance of the working machine.

DISCLOSURE OF THE INVENTION

The present invention is made by paying attention to the problems in the conventional art mentioned above, and an object of the present invention is to provide a hydraulically driven type working machine in which a rotary joint of a hydraulic pipe arrangement is provided in a boom hoisting supporting point and an arm joint connection supporting point, whereby a pipe arrangement can be installed in inner portions of a boom and an arm without applying a slack to the hydraulic pipe arrangement, the rotary joint of the hydraulic pipe arrangement is provided in a hoisting supporting point of a hydraulic actuator for driving a boom hoisting operation, whereby the pipe arrangement can be executed in the hydraulic actuator for driving the boom hoisting operation without slacking the hydraulic pipe arrangement from a side of a machine frame, and fluid flow passages communicating with respective cylinder oil chambers are provided in inner portions of respective cylinder rods, in the hydraulic actuator for driving the boom hoisting operation, a hydraulic actuator for driving an arm bending operation and a hydraulic actuator for driving a working tool so as to form the respective actuators that the hydraulic pipe arrangements are not exposed, thereby making the hydraulic pipe arrangements invisible from an outer appearance of the working machine, together with an effect of installing the pipe arrangements in the inner portions of the boom and the arm.

In order to achieve the object mentioned above, in accordance with a first aspect of the present invention, there is provided a hydraulically driven type working machine comprises a boom having a vertical swing supporting point supported at a base end side by a machine frame and a joint connection supporting point in a front end side, an arm connected in a base end side to the joint connection supporting point of the boom, a boom driving hydraulic cylinder hoisting around a hoist supporting point provided in the machine frame so as to drive the boom, an arm driving hydraulic cylinder driving the arm and a working tool driving hydraulic cylinder driving a working tool mounted to an arm front end side, wherein a swivel joint mechanism for relaying a hydraulic pipe arrangement from a side of the machine frame is provided at a center of at least one of the vertical swing supporting point, the joint connection supporting point and the boom driving hydraulic cylinder hoist supporting point.

In accordance with the first aspect, since at a time of pipe arrangement in the arm driving hydraulic cylinder and the working tool driving hydraulic cylinder, it is possible to execute a rotary joint pipe arrangement around the boom hoist supporting point by connecting a pipe arrangement extended from the side of the machine frame to one side hose joint of a swivel joint mechanism provided at the boom hoist supporting point and connecting a hydraulic cylinder side pipe arrangement extended along the boom side to another side hose joint rotating around the boom hoist supporting point, and it is not necessary to apply a slack to the hydraulic pipe arrangement between the side of the machine frame and the side of the swinging boom, it is possible to obtain an economical pipe arrangement, a durability of the hydraulic hose is improved due to no bending application to the pipe arrangement, and it is possible to correspond even to a narrow pipe arrangement space.

Further, in the pipe arrangement to the working device driving hydraulic cylinder extending to the arm via the boom, it is possible to execute the rotary joint pipe arrangement around the arm joint connection supporting point by connecting a pipe arrangement extended along the side of the boom to one side hose joint of the swivel joint mechanism at the center of the arm joint connection supporting point existing in a front end side of the boom and connecting a hydraulic cylinder side pipe arrangement extended along the arm side to another side hose joint rotating around the arm joint connection supporting point. Since it is not necessary to apply a slack to the hydraulic pipe arrangement between the boom and the arm bending with respect to the boom, it is possible to obtain an economical pipe arrangement, and a durability of the hydraulic hose is improved due to no bending application to the pipe arrangement.

Further, in the pipe arrangement from the side of the machine frame to the boom driving hydraulic cylinder, it is possible to execute the rotary joint pipe arrangement around the cylinder hoist supporting point by connecting the pipe arrangement extended from the side of the machine frame to one side hose joint of a swivel joint mechanism provided in the boom driving hydraulic cylinder hoist supporting point and connecting the pipe arrangement extended along the cylinder side to another side hose joint rotating around the cylinder hoist supporting point. Since it is not necessary to apply a slack to the hydraulic pipe arrangement between the machine frame side and the swinging cylinder side, it is possible to obtain an economical pipe arrangement and a durability of the hydraulic hose is improved due to no bending application to the pipe arrangement.

In accordance with a second aspect of the present invention, there is provided a hydraulically driven type working machine as recited in the first aspect, wherein the swivel joint mechanism has one side hose joint connected to the machine frame side and another side hose joint connected to the hydraulic cylinder side, and a hydraulic valve for shutting off at least one of a plurality of oil passages communicated another side hose joint with the hydraulic cylinder or restricting an area of the oil passages is provided in the oil passages.

In accordance with the second aspect of the present invention, since the oil passage to the hydraulic cylinder is shut off or the oil passage area is restricted at a time when another side hose joint is taken out for maintenance or the hydraulic pipe arrangement to the swivel joint mechanism is burst, the hydraulic cylinder does not suddenly expand or compress and the working machine does not drop down.

In accordance with a third aspect of the present invention, there is provided a hydraulically driven type working machine as recited in the first aspect, wherein the swivel joint mechanism at the center of the vertical swing supporting point of the boom is arranged between left and right divided supportng shaft pins of a forked boom swing supporting shaft portion, and is provided with one side hose joint of a pipe arrangement rotary joint concentric with a center of the supporting shaft pins connected to the machine frame side and another side hose joint connected to the boom side.

In accordance with the third aspect, since the swivel joint mechanism at the center of the boom vertical swing supporting point is arranged between the left and right divided supporting shaft pins of the forked boom swing supporting shaft portion, it is not necessary to secure a surplus arrangement space around the boom hoist supporting point. Further, since the swivel joint mechanism is arranged immediately below the boom and the hydraulic pipe arrangement is installed in the boom, whereby the pipe arrangement does not expose to an external portion from the immediately below portion of the boom, the swivel joint mechanism and the pipe arrangement are sufficiently protected.

In accordance with a fourth aspect of the present invention, there is provided a hydraulically driven type working machine as recited in the first aspect, wherein the swivel joint mechanism at the center of the joint connection supporting point of the arm is arranged between left and right divided supportng shaft pins of a forked arm joint connection supporting shaft portion, and is provided with one side hose joint of a pipe arrangement rotary joint concentric with a center of the supporting shaft pins connected to the boom side and another side hose joint connected to the arm side.

In accordance with the fourth aspect, since the swivel joint mechanism at the center of the arm joint connection supporting point is arranged between the left and right divided supporting shaft pins of the forked arm joint connection supporting shaft portion, the swivel joint mechanism does not expose to an external portion from a profile of the boom and the arm, thereby preventing damage.

In accordance with a fifth aspect of the present invention, there is provided a hydraulically driven type working machine as recited in the first aspect, wherein the swivel joint mechanism at the center of the boom driving hydraulic cylinder hoist supporting point is arranged close by a supporting shaft pin which is the hoist supporting point of the boom driving hydraulic cylinder, and is provided with one side hose joint of a pipe arrangement rotary joint concentric with a center the of supporting shaft pin connected to the machine frame side and another side hose joint connected to the boom driving hydraulic cylinder side.

In accordance with the fifth aspect of the present invention, the boom driving hydraulic cylinder hoist supporting point is a hoist supporting point of a boom driving hydraulic cylinder structures such as to connect a front end portion of a piston rod having oil passages respectively extending to a head side oil chamber and a bottom side oil chamber of the boom driving hydraulic cylinder to the side of the machine frame by a supporting shaft pin, and the swivel joint mechanism relaying the pipe arrangement to the boom driving hydraulic cylinder is arranged in the center of the hoist supporting point. Accordingly, the pipe arrangement of the boom driving hydraulic cylinder is supplied from one side hose joint rotating together with the hoist of this cylinder to the cylinder, and a length of the pipe arrangement can be significantly reduced in comparison with the conventional one.

In accordance with a sixth aspect of the present invention, there is provided a hydraulically driven type working machine as recited in the third aspect, wherein one side supporting shaft pin of the left and right divided supporting shaft pins in the boom swing supporting shaft portion has a connection flow passage connecting the machine frame side pipe arrangement to the swivel joint mechanism, the one side hose joint is a columnar joint having a pipe arrangement joint flow passage in the side of the machine frame mounted to an axial direction of the one side supporting shaft pin, the another side hose joint is a cylindrical joint fitted to the columnar joint and provided with a plurality of inner circumferential annular grooves communicated with the pipe arrangement joint flow passage of the columnar joint and respective through holes communicated with these inner circumferential annular grooves, a boom built-in pipe arrangement is mounted to the cylindrical joint, and the swivel joint mechanism is connected to the boom so that the cylindrical joint rotates together with the swing motion of the boom in a following manner.

In accordance with the sixth aspect of the present invention, since the structure is made such that the machine frame side pipe arrangement is taken in the lower side of the boom base end via the boom supporting shaft pin, it is not necessary to execute the pipe arrangement via the boom bracket, and it is possible to reduce the length of the pipe arrangement in comparison with the conventional one.

In accordance with a seventh aspect of the present invention, there is provided a hydraulically driven type working machine as recited in the fourth aspect, wherein the another side hose joint of the swivel joint mechanism at the center of the arm joint connection supporting point is constituted by a joint in which a pipe arrangement block and a columnar joint concentric with the center of the supporting shaft pin are integrally formed in an L shape so as to form an interior communication flow passage extending from the columnar joint to the pipe arrangement block, the one side hose joint is constituted by a cylindrical joint fitted to the columnar joint and provided with a plurality of inner circumferential annular grooves communicated with the interior communication flow passage and respective through holes communicated with these inner circumferential annular grooves, the cylindrical joint is connected to the boom side so as to form a connection joint of a boom built-in pipe arrangement, and the pipe arrangement block is mounted to the arm side so as to form a connection joint of an arm built-in pipe arrangement.

In accordance with the seventh aspect of the present invention, a plurality of internal communication passages in the columnar joint of the swivel joint mechanism at the center of the joint connection supporting point is communicated with a plurality of inner communication passages directed to the arm front end direction of the pipe arrangement block. Accordingly, since the direction of the pipe arrangement with respect to the working tool driving hydraulic cylinder is aligned so as to be directed to the front end of the arm, it is unnecessary to execute the pipe arrangement within the arm, the pipe arrangement is simplified, and an assembling property of the pipe arrangement is improved. Further, since the pipe arrangement is not exposed, a good appearance can be obtained.

In accordance with an eighth aspect of the present invention, there is provided a hydraulically driven type working machine as recited in the fifth aspect, wherein the another side hose joint of the swivel joint mechanism at the center of the boom driving hydraulic cylinder hoist supporting point is constituted by a joint in which a pipe arrangement block and a columnar joint concentric with the center of the supporting shaft pin are integrally formed in an L shape so as to form an interior communication flow passage extending from the columnar joint to the pipe arrangement block, the one side hose joint is constituted by a cylindrical joint fitted to the columnar joint and provided with a plurality of inner circumferential annular grooves communicated with the interior communication flow passage and respective through holes communicated with these inner circumferential annular grooves, the cylindrical joint is connected to the machine frame side so as to form a connection joint of a machine frame side pipe arrangement, and the pipe arrangement block is formed as a connection joint of a boom driving hydraulic cylinder side pipe arrangement.

In accordance with the eighth aspect of the present invention, a plurality of internal communication passages in the columnar joint of the swivel joint mechanism provided at the center of the boom driving hydraulic cylinder hoist supporting point is communicated with a working fluid supply flow passage port provided in the front end portion of the piston rod of the boom cylinder via a plurality of inner communication passages. Accordingly, since it is unnecessary to execute the pipe arrangement extending from the machine frame to the boom driving hydraulic cylinder in an outer portion near the boom driving hydraulic cylinder hoist supporting point, the pipe arrangement is simplified, and an assembling property is improved. Further, since the pipe arrangement is not exposed, a good appearance can be obtained.

In accordance with a ninth aspect of the present invention, there is provided a hydraulically driven type working machine comprises a boom driving hydraulic cylinder, an arm driving hydraulic cylinder and a working tool driving hydraulic cylinder are formed as hydraulic cylinders respectively having communication passages supplying and discharging a working oil fluid from inner portions of respective piston rods to head side oil chambers and bottom side oil chambers in piston chambers within respective cylinders, respective cylinders sides of the driving hydraulic cylinders are respectively connected to the boom, the arm and the working tool side so as to form longitudinally moving bodies, and respective piston rod sides are respectively arranged so as to form hoist supporting points by supporting shaft pins via supporting brackets provided in the machine frame, the boom and the arm side, wherein the hydraulically driven type working machine is provided with a first swivel joint mechanism mounting a boom built-in pipe arrangement to a cylindrical joint and connected to the boom so that the cylindrical joint rotates together with a swing motion of the boom, a third swivel joint mechanism connecting a cylindrical joint to the boom side so as to form a connection joint of a boom built-in pipe arrangement and setting a pipe arrangement block and a columnar joint integrally mounted to the arm side to a connection joint of an arm built-in pipe arrangement, and a second swivel joint mechanism connecting a cylindrical joint to the machine frame side so as to form a connection joint of a machine frame side pipe arrangement and setting a pipe arrangement block and a columnar joint to a connection joint of a boom driving hydraulic cylinder side pipe arrangement, wherein in the hydraulic pipe arrangement to the arm driving hydraulic cylinder, the boom built-in pipe arrangement extending via the first swivel joint mechanism is connected to a front end portion of the piston rod in the arm driving hydraulic cylinder, wherein in the hydraulic pipe arrangement to the working tool driving hydraulic cylinder, the arm built-in pipe arrangement extending via the third swivel joint mechanism is connected to a front end portion of the piston rod in the working tool hydraulic cylinder, and wherein in the hydraulic pipe arrangement to the boom driving hydraulic cylinder, the pipe arrangement block and the columnar joint of the second swivel joint mechanism are integrally connected to the piston rod of the boom driving hydraulic cylinder, whereby the respective hydraulic pipe arrangement to the driving hydraulic cylinders are not exposed to an external portion.

In accordance with the ninth aspect of the present invention, the first swivel joint mechanism at the center of the vertical swing supporting point supplies the oil to one portion in the front end portion of the piston rod having the oil passage extending to the head side oil chamber and the bottom side oil chamber of the arm driving hydraulic cylinder. In this case, the front end portion of the piston rod is connected to a fixed rotation supporting point in the boom side. Accordingly, the pipe arrangement to the arm driving hydraulic cylinder is not exposed to the external portion. Further, the third swivel joint mechanism at the center of the joint connection supporting point supplies the oil to one portion in the front end portion of the piston rod having the head side oil chamber and the bottom side oil chamber of the working tool driving hydraulic cylinder. In this case, the front end portion of the piston rod is connected to the fixed rotation supporting point in the arm side. Accordingly, the pipe arrangement to the working tool driving hydraulic cylinder is not exposed to the external portion. Further, the pipe arrangement block of the second swivel joint mechanism provided at the hoist supporting point of the boom driving hydraulic cylinder and the piston rod of the boom driving hydraulic cylinder are integrally connected to each other. In accordance with these structures, since the pipe arrangements to the respective driving cylinders are not exposed to the external portion, the pipe arrangements do not interfere with an obstacle such as an electric wire, a ceiling of a tunnel or the like during the operation so as to be broken. Further, since the piston rod does not also interfered with the obstacle, it is possible to prevent the piston rod from being damaged.

DETAILED DESCRIPTION OF PREFERRED EMBODIMENT

A description will be in detail given below of a preferable embodiment in accordance with the present invention with reference to the accompanying drawings.

Figure 1:
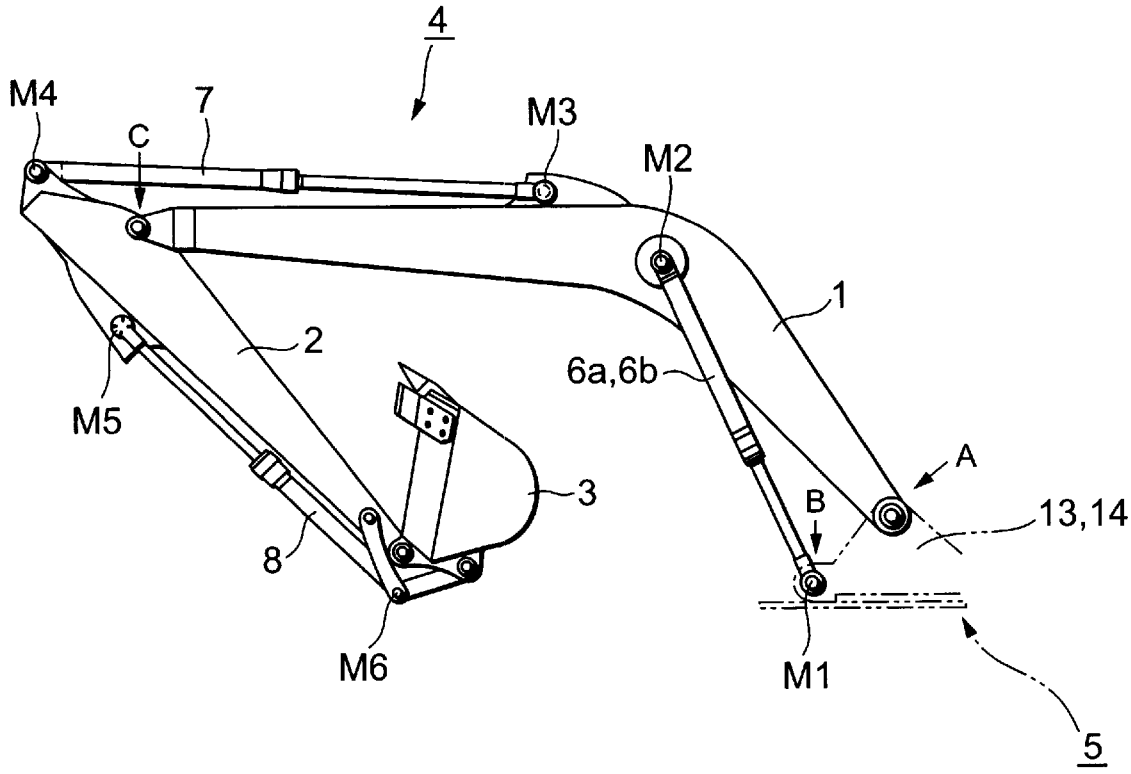
FIG. 1 is a schematic view of a whole of a hydraulically driven type working machine in accordance with an embodiment of the present invention.

FIG. 1 is a schematic view of a whole of a hydraulically driven type working machine in accordance with the present embodiment.

A working machine 4 constituted by a boom 1, an arm 2 and a bucket 3 arranged in series is supported by a base table 5. A base end of the boom 1 is pivoted to an upper end portion of the base table 5 so as to freely rotate vertically, and two boom driving hydraulic cylinders (hereinafter, refer to boom cylinders) 6*a* and 6*b* are arranged between a front end portion M1 of the base table 5 and a side surface M2 of a middle portion in the boom 1. A base end of the arm 2 is pivoted to a front end of the boom 1 so as to freely rotate vertically, and an arm driving hydraulic cylinder (hereinafter, refer to an arm cylinder) 7 is provided between an upper surface M3 of a middle portion in the boom 1 and a backward extending portion M4 of the arm 2. Further, a rear end lower portion of the bucket 3 is pivoted to a front end of the arm 2, and a working tool driving hydraulic cylinder (hereinafter, refer to a bucket cylinder) 8 is arranged between an upper surface M5 of a middle portion in the arm 2 and a rear end upper portion M6 of the working tool (hereinafter, refer to a bucket)3. Rod head sides of the respective cylinders 6*a*, 6*b*, 7 and 8 are rotatably attached to the portions M1, M3 and M5, and cylinder tube sides thereof are rotatably attached to the portions M2, M4 and M6, respectively. The boom cylinders 6*a* and 6*b* rotate the boom 1 with respect to the base table 5, the arm cylinder 7 rotates the arm 2 with respect to the boom 1 and the bucket cylinder 8 rotates the bucket 3 with respect to the arm 2, respectively.

Figure 2:
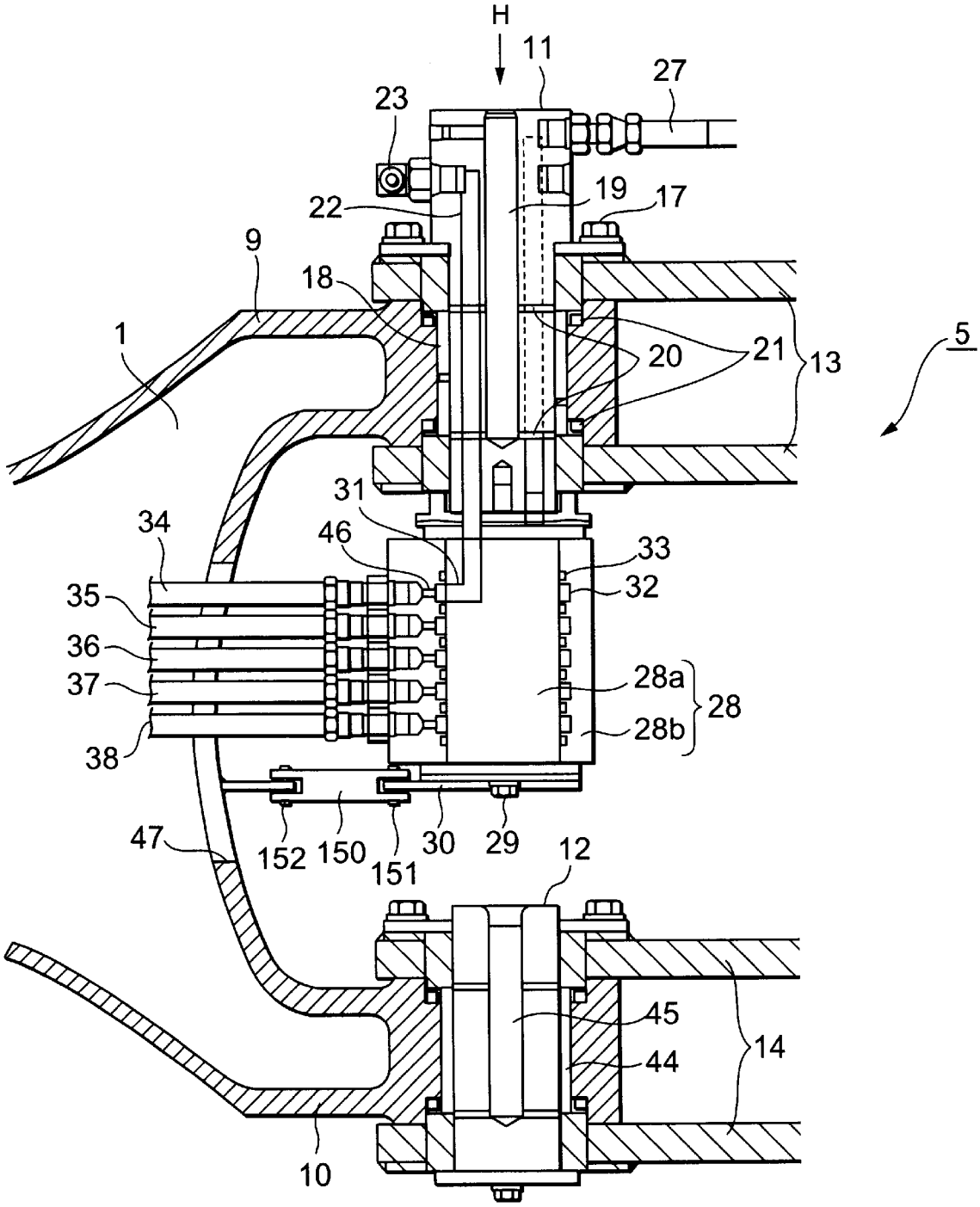
FIG. 2 is an enlarged schematic view of a hydraulic pipe arrangement in a boom base end portion, corresponding to a view as seen from an arrow A in FIG. 1.

FIG. 2 shows a view as seen from an arrow A in FIG. 1.

The base end portion of the boom 1 and the base table 5 are respectively branched into right and left portions, and boom base end left and right portions 9 and 10 are supported to base table left and right portions 13 and 14 via boom base end left and right shafts 11 and 12 corresponding to left and right divided supporting shaft pins. In this case, the base table left and right portions 13 and 14 are respectively constituted by a pair of plates arranged so as to oppose to each other.

The boom base end right shaft 11 passes through the base table right portion 13 and is fixed to the base table right portion 13 by a bolt 17. Further, a bush 18 is pressure inserted into the boom base end right portion 9, and the boom base end right shaft 11 is fitted and inserted into an inner surface of the bush 18. An oil sealing hole 19 is pierced in a longitudinal direction of a substantially center portion of the boom base end right shaft 11, and oil passages 20 are radially provided near both end surfaces of the boom base end right portion 9 extended from the oil sealing hole 19. Further, an oil seal 21 preventing an oil leakage is provided near both end surfaces of the boom base end right portion 9.

Figure 3:
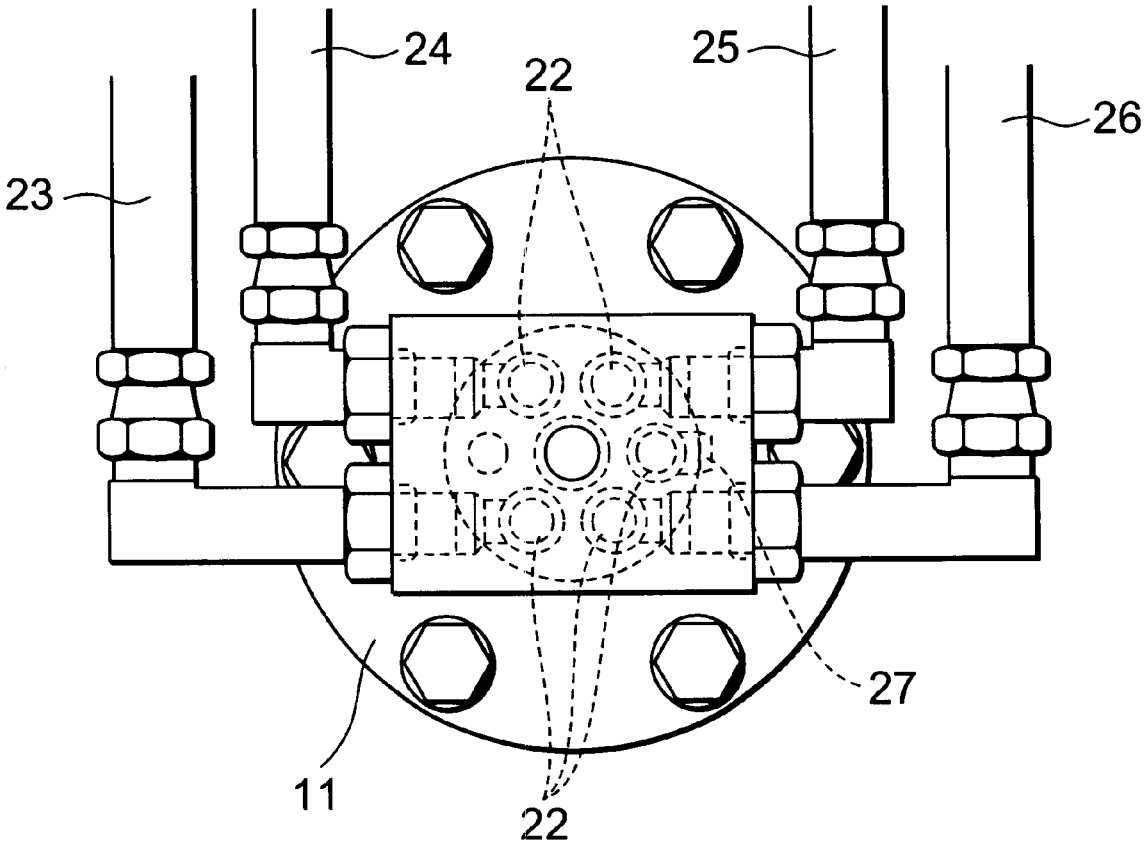
FIG. 3 is a view as seen from an arrow H in FIG. 2

Five oil passages 22 are pierced in a longitudinal direction in an inner portion of the boom base end right shaft 11, and these oil passages 22 are arranged around the oil sealing hole 19. One ends of a bucket bottom hose 23, a bucket head hose 24, an arm bottom hose 25, an arm head hose 26 and a drain hose 27 communicated with five oil passages 22 are respectively connected to a right end portion of the boom base end right shaft 11, as shown in FIG. 3 corresponding to a view seen from an arrow H in FIG. 2. Another ends of the respective hoses are respectively connected to a hydraulic power source (not shown) in a side of the base table 5.

The arm bottom hose 25 and the arm head hose 26 correspond to hoses for feeding an oil to a bottom chamber and a head chamber of the arm cylinder 7, and the bucket bottom hose 23 and the bucket head hose 24 correspond to hoses for feeding the oil to a bottom chamber and a head chamber of the bucket cylinder 8. In this case, the drain hose 27 corresponds to a hose for draining an oil leaking within a swivel joint mechanism mentioned below to a tank.

A first swivel 28 corresponding to a swivel joint mechanism (hereinafter, refer to a swivel) capable of feeding the oil between a stationary portion and a rotary portion is provided in a left end surface of the boom base end right shaft 11. The first swivel 28 has a first columnar joint 28*a* corresponding to one side hose joint and a first cylindrical joint 28*b* corresponding to another side hose joint, thereby constituting a pipe arrangement rotary joint. The first columnar joint 28*a* fitted and inserted to the first cylindrical joint 28*b* is adhered to the left end surface of the boom base end right shaft 11 by a bolt 29. On the contrary, the first cylindrical joint 28*b* is fixed to the boom 1 via a link 150. In this case, both end portions of the link 150 are rotatably mounted to the first cylindrical joint 28*b* and the boom 1 by pins 151 and 152, and the first cylindrical joint 28*b* rotates together with the boom 1 at a time when the boom 1 rotates around the boom base end right shaft 11.

Five oil passages 31 corresponding to pipe arrangement joint flow passages are pieced in a longitudinal direction in an inner portion of the first columnar joint 28*a*, and these five oil passages 31 are provided at positions aligned with five oil passages 22 corresponding to connection flow passages and pierced in the longitudinal direction of the inner portion of the boom base end right shaft 11. Five inner circumferential annular grooves 32 are provided on a fitting surface of the first cylindrical joint 28*b* to the first columnar joint 28*a*, and these inner circumferential annular grooves 32 are respectively communicated with corresponding oil passages among five oil passages 31. In this case, each of the inner circumferential annular grooves 32 is isolated by each of swivel oil seals 33 in order to prevent an oil leakage between respective grooves.

Respective through holes 46 are pierced from five inner circumferential annular grooves 32 toward the outer circumferential surface of the first cylindrical joint 28*b*, and one ends of a bucket bottom hose 34, a bucket head hose 35, an arm bottom hose 36, an arm head hose 37 and a drain hose 38 corresponding to the respective through holes 46 are respectively connected to the outer circumferential surface of the first cylindrical joint 28*b*. The respective hoses 34, 35, 36, 37 and 38 feed the oil supplied from five hoses 23, 24, 25, 26 and 27 attached to the right end portion of the boom base end right shaft 11 to the arm cylinder 7 and the boom front end portion through the inner portion of the boom via an opening portion 47 of the boom 1. In FIG. 2, there are exemplified only an oil passage and an oil groove which communicate the bucket bottom hose 23 connected to the right end portion of the boom base end right shaft 11 with the bucket bottom hose 34 connected to the first cylindrical joint portion 28*b*.

The structure near the base table right portion 13 is made as mentioned above, however, in the base table left portion 14, the boom base end left portion 10 is rotatably supported via a bush 44 and the boom base end left shaft 12.

The boom base end left shaft 12 does not have the swivel as provided in the boom base end right shaft 11, however, since the structures of the bush 44, an oil sealing hole 45 and the like are the same as those of the boom base end right shaft 11, a description thereof will be omitted.

Figure 4:
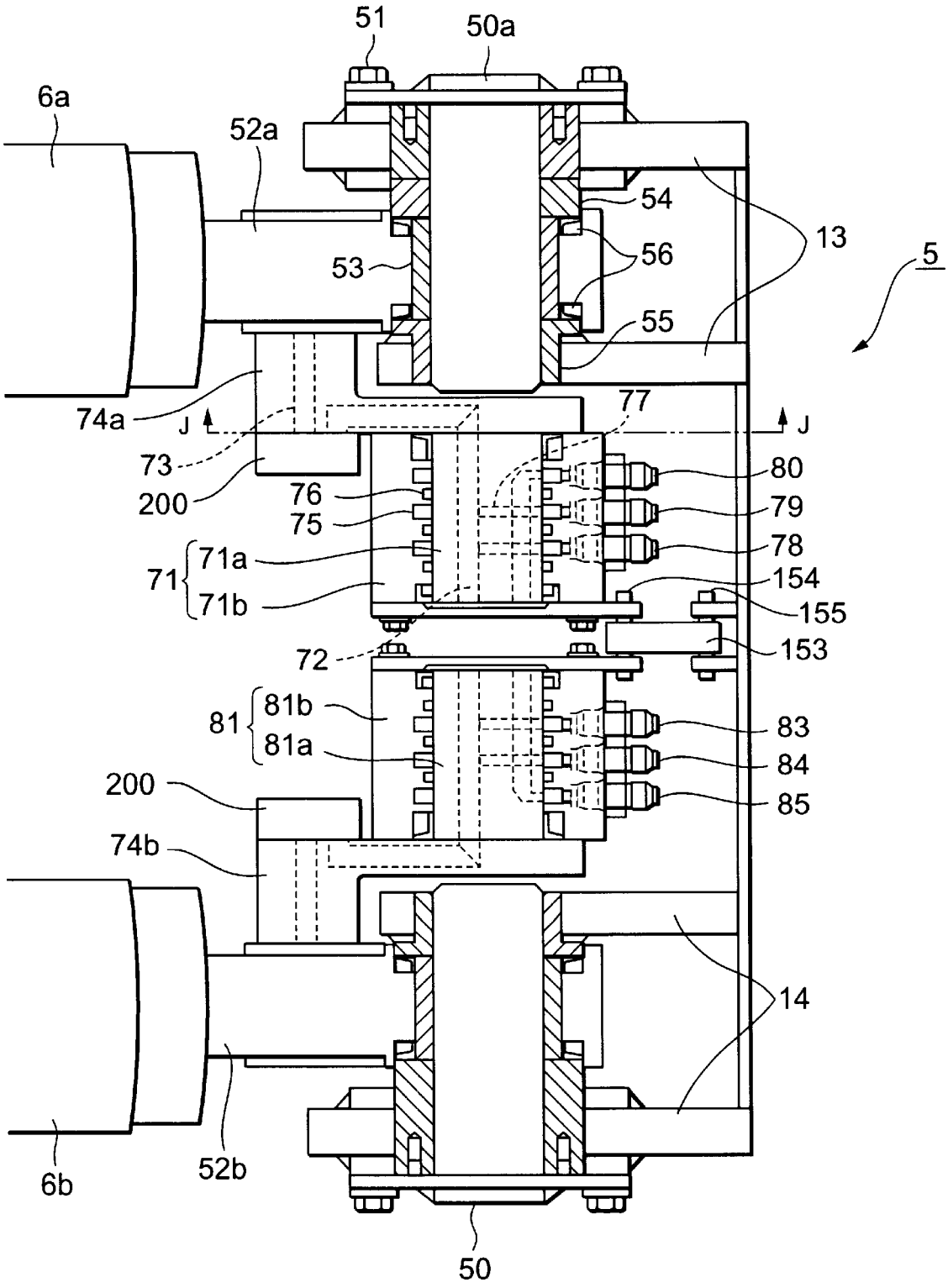
FIG. 4 is an enlarged schematic view of the hydraulic pipe arrangement in a boom cylinder base end portion, corresponding to a view as seen from an arrow B in FIG. 1.

FIG. 4 shows a view as seen from an arrow B in FIG. 1.

A right boom cylinder base end shaft 50*a* passes through the base table right portion 13 and is fixed to the base table right portion 13 by a bolt 51. Further, a bush 53 is pressure inserted to an end portion of a rod in the right boom cylinder 6*a*. The right boom cylinder base end shaft 50*a* is rotatably fitted and inserted to an inner surface of the bush 53, and the base table right portion 13 is arranged between left and right side anchors 54 and 55 attached to the base table right portion 13. Further, respective dust seals 56 and 56 for preventing dusts from entering are provided near both end surfaces of the bush 53.

Since the structure in which the left boom cylinder base end shaft 50 is mounted to the base table left portion 14 is the same as the structure in which the right boom cylinder base end shaft 50*a* is mounted to the base table right portion 13, a description thereof will be omitted here.

Figure 5:
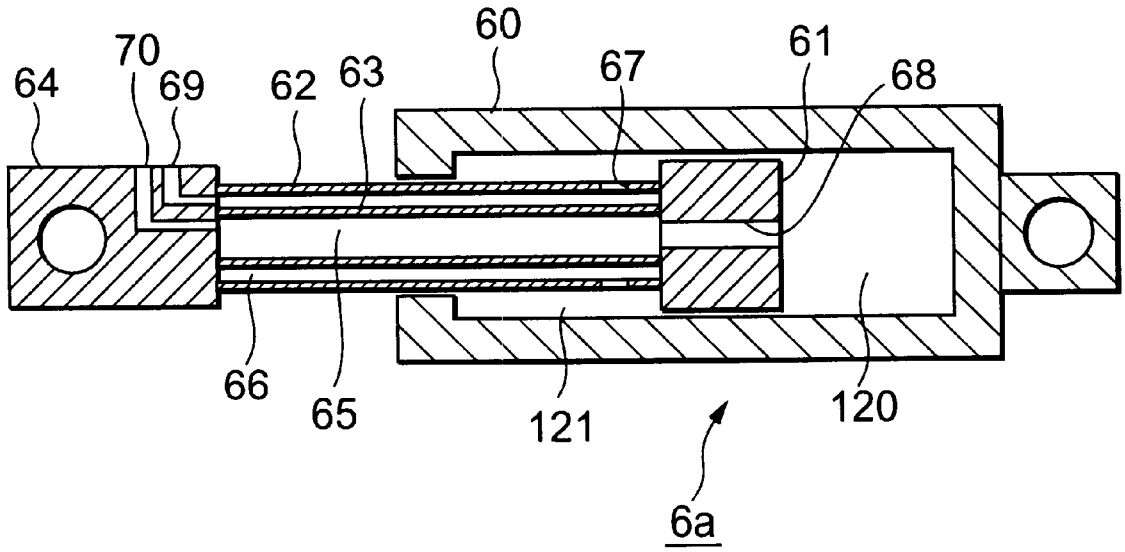
FIG. 5 is an enlarged schematic view of a structure of the boom cylinder.

In this case, a description will be given of a structure of the right boom cylinder 6*a* as an example, with reference to FIG. 5.

The right boom cylinder 6*a* has a cylinder tube 60, a piston 61, a hollow rod 62, a pipe member 63 and a rod head 64. The pipe member 63 having an outer diameter smaller than an inner diameter of the hollow rod 62 is inserted to an inner portion of the hollow rod 62, and both end surfaces of the hollow rod 62 and the pipe member 63 are sealed by the piston 61 and the rod head 64. An inner portion of the pipe member 63 forms a first bottom communication passage 65 through which an oil in a bottom chamber 120 moves, and a space between an inner surface of the hollow rod 62 and an outer surface of the pipe member 63 forms a first head communication passage 66 through which an oil in a head chamber 121 moves. Further, a head hole 67 through which the oil in the head chamber 121 moves is provided in an end portion of the hollow rod 62 close to the piston 61, and a bottom hole 68 through which the oil in the bottom chamber 120 moves is provided in the piston, respectively. Further, a second head communication passage 69 through which the oil in the head chamber 121 moves and a second bottom communication passage 70 through which the oil in the bottom chamber 120 moves are respectively provided in the rod head 64.

The oil supplied from the second head communication passage 69 flows in the head chamber 121 via the first head communication passage 66 and the head hole 67, thereby compressing the cylinder backward. At this time, the oil in the bottom chamber 120 is discharged from the second bottom communication passage 70 via the bottom hole 68 and the first bottom communication passage 65. When the oil is supplied from the second bottom communication passage 70, the oil flows in an opposite direction to the direction in which the cylinder compresses backward, whereby the cylinder expands.

All of the left boom cylinder 6*b*, the arm cylinder 7 and the bucket cylinder 8 used in the present embodiment are constituted by a cylinder having the same structure as that of the right boom cylinder 6*a*.

Next, a description will be given of a structure of a second right swivel 71 having an oil passage feeding an oil to the right boom cylinder 6*a* with reference to FIG. 4.

Figure 6:
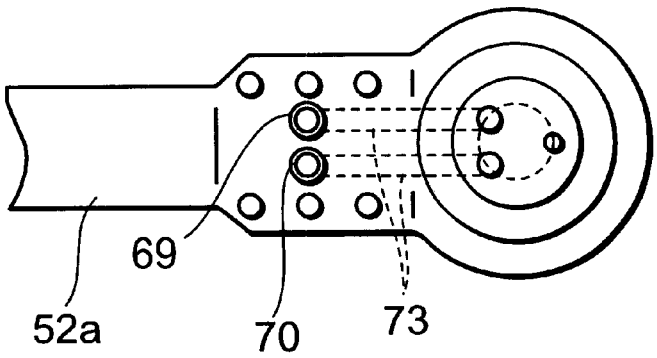
FIG. 6 is a view as seen from an arrow J in FIG. 4.

A second swivel 71 having a second right columnar joint 71*a* corresponding to another side hose joint and a second right cylindrical joint 71*b* corresponding to one side hose joint is provided in a left side of the right boom cylinder base end shaft 50*a* corresponding to the right supporting shaft pin, thereby constituting a pipe arrangement rotary joint. A center shaft of the second right columnar joint 71*a* is concentrically arranged with the center shaft of the right boom cylinder base end shaft 50*a*. Three oil passages 72 corresponding to the pipe arrangement joint flow passage are pieced in the second right columnar joint 71*a*, and a pipe arrangement block 74*a* communicating two oil passages 72 among them with the rod 52*a* is provided in an extending manner. Respective oil passages 73 pieced in the pipe arrangement block 74*a* are communicated with the head flow passage 69 and the bottom flow passage 70 pierced on the end surface of the rod 52*a*, as shown in FIG. 6 corresponding to a view as seen from an arrow J in FIG. 4. In this case, the remaining one oil passage 72 is an oil passage for draining a leakage within the second right swivel 71 to the tank. A drop preventing valve 200 mentioned below is mounted to an end surface of the pipe arrangement block 74*a*. The drop preventing valve 200 is structured such as to prevent the boom 1 from dropping down at a time of taking out the second right swivel 71 for maintenance or the like.

Second left and right cylindrical joints 71*b* and 81*b* are fixed to the machine frame via a link 153. In this case, both end portions of the link 153 are rotatably mounted to the second left and right cylindrical joints 71*b* and 81*b* and the machine frame by respective pins 154 and 155, and the second left and right cylindrical joints 71*b* and 81*b* always stand still even when the left and right boom cylinders 6*a* and 6*b* rotate around the left and right boom cylinder base end shafts 50 and 50*a*. Three circumferential annular grooves 75 are provided on a fitting surface of the second right cylindrical joint 71*b* to the second right columnar joint 71*a*, and these circumferential annular grooves 75 are respectively communicated with corresponding oil passages among the three oil passages 72. In this case, the three circumferential annular grooves 75 are isolated by respective swivel oil seals 76 in order to prevent an oil leakage between respective grooves.

Respective through holes 77 are pierced from three circumferential annular grooves 75 toward the outer circumferential surface of the first right cylindrical joint 71*b*, and one ends of a right boom bottom hose 78, a right boom head hose 79 and a drain hose 80 corresponding to the respective through holes 77 are respectively connected to the outer circumferential surface of the second right cylindrical joint 71*b*. Respective another ends are connected to a hydraulic power source in the side of the base table 5.

In this case, a difference between the left boom cylinder 6*b* which the base table left portion 14 supports and the right boom cylinder 6*a* mentioned above exists only in a matter that a second left swivel 81 is attached to the end surface of the rod 52*b* of the left boom cylinder 6*b* in a mirror image manner with respect to the rod 52*a* of the right boom cylinder 6*a*.

One ends of a left boom bottom hose 83, a left boom head hose 83, a left boom head hose 84 and a drain hose 85 are respectively connected to an outer periphery of the second left cylindrical joint 81*b*. Another ends thereof are respectively connected to the hydraulic power source in the side of the base table 5. Further, the left boom bottom hose 83 and the left boom head hose 84 are communicated with the head flow passage and the bottom flow passage of the left boom cylinder 6*b* via the second left columnar joint 81*a* and the second left cylindrical joint 81*b*. In this case, the drop preventing valve 200 is also mounted to an end surface of the pipe arrangement block 74*b* in the left boom cylinder 6*b* corresponding to the pipe arrangement block 74*a* of the right boom cylinder 6*a*.

Figure 7:
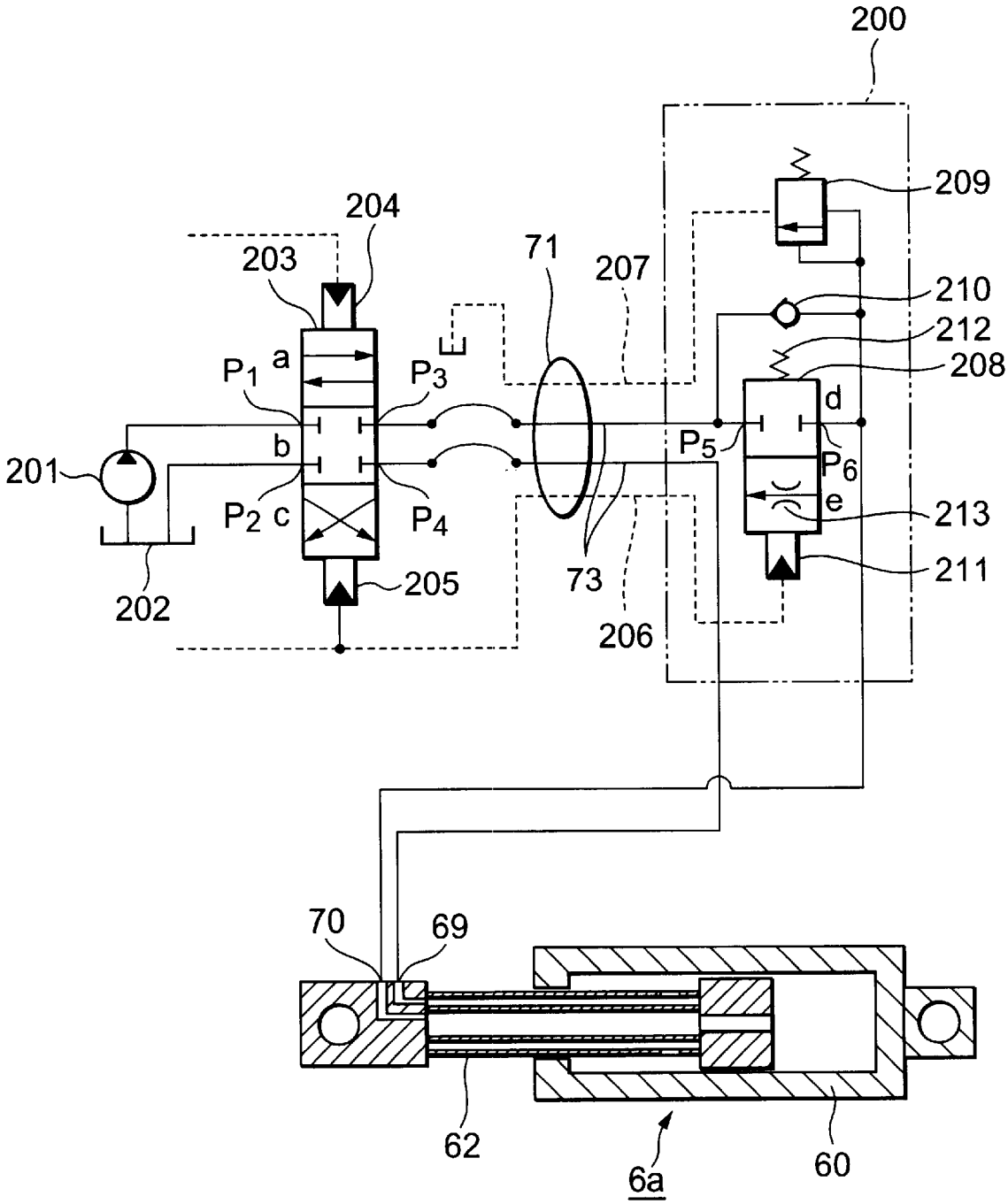
FIG. 7 is a view of a hydraulic circuit including a drop preventing valve of the boom cylinder.

Next, a description will be given of a hydraulic circuit including the drop preventing valve 200 with reference to FIG. 7 on the basis of an example of the right boom cylinder 6*a*.

The oil sucked from a tank 202 in the hydraulic pump 201 is supplied to a port P1 in a flow amount control valve 203 having three positions a, b and c. A port P2 is communicated with the tank 202. The flow amount control valve 203 has an ascending pressure receiving portion 204 and a descending pressure receiving portion 205, the position a is operated when a predetermined pressure is supplied to the descending pressure receiving portion 204, and the position c is operated when a predetermined pressure is supplied to the descending pressure receiving portion 205. The position b is operated when the oil pressure is not supplied to the ascending pressure receiving portion 204 and the descending pressure receiving portion 205. Ports P3 and P4 are communicated with oil passages 73 having two flow passages via the second right swivel 71.

Further, the drop preventing valve 200 and the second right swivel 71 are communicated with each other via a pilot pressure passage 206 and a drain passage 207. In this case, the pilot pressure passage 206 and the drain passage 207 are not shown in FIG. 4.

The drop preventing valve 200 has a switch valve 208, a safety valve 209 and a check valve 210. One oil passage of the oil passages 73 is communicated with the switch valve 208 having two positions d and e. Further, the switch valve 208 has a switching pressure receiving portion 211 and a spring 212, and a position e is operated against an urging force of the spring when a predetermined pressure is supplied to the switching pressure receiving portion 211 via the pilot pressure passage 206. When the oil pressure is not supplied to the switching pressure receiving portion 211, a position d is operated. At the position d, the flow passage is shut off between the ports P5 and P6, and at the position e, the flow amount flowing from the port P6 to the port P5 is throttled by a throttle 213. The safety valve 209 relieves when the oil pressure of the port P6 is equal to or more than a predetermined value, and the relieved oil returns to the tank 202 via the drain passage 207. The check valve 210 is arranged between the ports P5 and P6 so as to freely pass the flow from the port P5 toward the port P6 and stop the flow from the port P6 toward the port P5.

Another oil passage of the oil passages 73 is communicated with the head flow passage 69 of the right boom cylinder 6*a* through the inner portion of the drop preventing valve 200 and the port P6 is communicated with the bottom flow passage 70, respectively.

Figure 8:
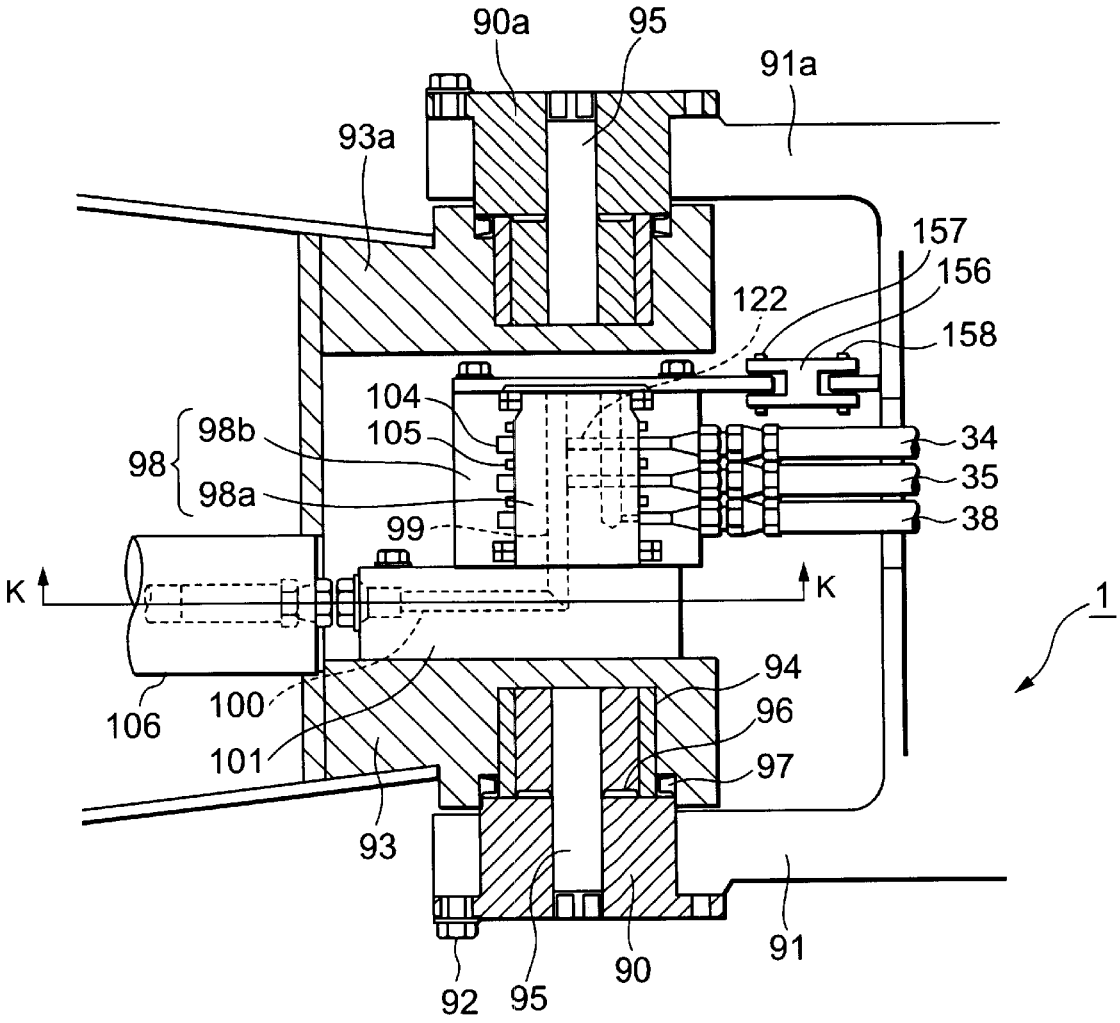
FIG. 8 is an enlarged schematic view of a hydraulic pipe arrangement in an arm base end portion, corresponding to a view as seen from an arrow C in FIG. 1.

FIG. 8 shows a view as seen from an arrow C in FIG. 1.

An arm base end left shaft 90 corresponding to the left separation supporting shaft pin passes through a boom front end left portion 91 and is fixed to the boom front end left portion 91 by a bolt 92. In this case, a bush 94 is pressure inserted into an end portion of the arm base end left portion 93. An inner surface of the bush 94 is rotatably fitted and inserted into the arm base end left shaft 90.

An oil sealing hole 95 is pierced in a longitudinal direction of a substantially center portion of the arm base end left shaft 90, and a plurality of oil passages 96 are radially provided near one end of the bush 94 from the oil sealing hole 95. Further, an oil seal 97 for preventing an oil leakage is provided near one end of the bush 94.

A third swivel 98 feeding an oil to the bucket cylinder 8 is provided in a right side of the arm base end left shaft 90. The third swivel 98 has a third columnar joint 98*a* corresponding to another side hose joint and a third cylindrical joint 98*b* corresponding to one side hose joint, thereby constituting a pipe arrangement rotary joint. In this case, a center shaft of the third columnar joint 98*a* is concentrically arranged with the center shaft of the arm base end left shaft 90. Three oil passages 99 corresponding to the pipe arrangement joint flow passage are provided in the third columnar joint 98*a*, and a bending portion 101 communicating two oil passages 100 among them with these hoses so that directions of a bucket bottom hose 102 and a bucket head hose 103 are aligned with an arm front end direction in an extending manner, thereby forming an inner communication flow passage (refer to FIG. 8 and FIG. 9 corresponding to a view as seen from an arrow K in FIG. 8). The bucket hoses 102 and 103 are communicated with the head flow passage 89 and the bottom flow passage 88 of the bucket cylinder 8 shown in FIG. 12 through a hose guide 106 arranged in an inner portion of the arm 2. Remaining one oil passage is an oil passage for draining a leakage within the third swivel 98 to the tank. In this case, the pipe arrangement block 101 is mounted to the arm base end left portion 93.

Third cylindrical joint 98*b* is fixed to the boom 1 via a link 156. In this case, both end portions of the link 156 are rotatably mounted to the third cylindrical joint 98*b* and the boom 1 by pins 157 and 158, and the third cylindrical joint 98*b* stands still together with the boom 1 even when the arm base end left portion 93 rotate around the arm base end left shaft 90. Three inner circumferential annular grooves 104 are provided on a fitting surface of the third cylindrical joint 98*b* to the third columnar joint 98*a*, and three inner circumferential annular grooves 104 are respectively communicated with corresponding oil passages among three oil passages 99. In this case, these inner circumferential annular grooves 104 are isolated by respective swivel oil seals 105 in order to prevent an oil leakage between respective grooves.

Respective through holes 122 are pierced from three oil grooves 104 toward an outer peripheral surface of the third cylindrical joint 98*b*, and one ends of the bucket bottom hose 34, the bucket head hose 35 and the drain hose 38 corresponding to the respective through holes 122 are respectively connected to the outer circumference of the third cylindrical joint 98*b*. In this case, another ends of the respective hoses are connected to the outer circumference of the first cylindrical joint 28*b*.

The third swivel attached to the arm base end left shaft 90 is not attached to the arm base end right portion 93*a* which the boom front end right portion 91*a* supports. Since the other structures of the arm base end right shaft 90*a* corresponding to the right separation supporting shaft in and the like are the same, a description of portions near the boom front end right portion 91*a* will be omitted.

Figure 10:
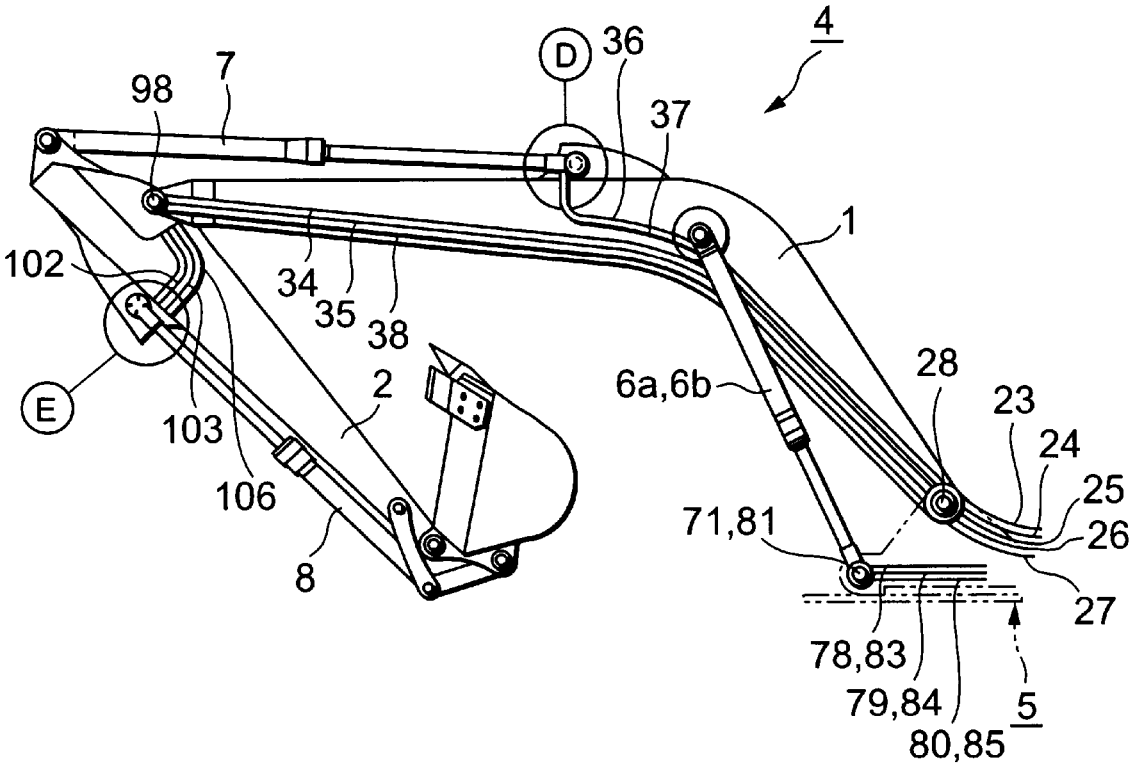
FIG. 10 is a schematic view of a whole of a hydraulic pipe arrangement built in the hydraulically driven type working machine in accordance with the present embodiment.

Next, FIG. 10 is a perspective view showing a whole pipe arrangement of the working machine 4 having the first swivel 28, the second left and right swivels 71 and 81 and the third swivel 98. In this case, in FIG. 10, one pipe arrangement is expressed by one solid line.

Among the bucket bottom hose 23, the bucket head hose 24, the arm bottom hose 25, the arm head hose 26 and the drain hose 27 arranged in the first swivel 28 from the hydraulic power source on the base table 5, the hoses 34, 35 and 38 corresponding to the hoses 23, 24 and 27 are connected to the third swivel 98. Further, the hoses 36 and 37 corresponding to the hoses 25 and 26 are connected to the rod head portion of the arm cylinder 7. Further, the hoses 102 and 103 corresponding to the hoses 34 and 35 are connected to the rod head portion of the bucket cylinder 8 via the third swivel 98. The hoses 34, 35, 36, 37 and 38 arranged in a downstream side of the first swivel 28 are all built in the boom 1 and are not exposed.

Among the left and right boom bottom hoses 78 and 83, the left and right boom head hoses 79 and 84 and the drain hoses 80 and 85 arranged from the hydraulic power source on the base table 5 toward the rod heads of the left and right boom cylinders 6*a* and 6*b*, the hoses 78, 83, 79 and 84 are communicated with the rod head of the boom cylinder 6 via the second left and right swivels 71 and 81.

Figure 11:
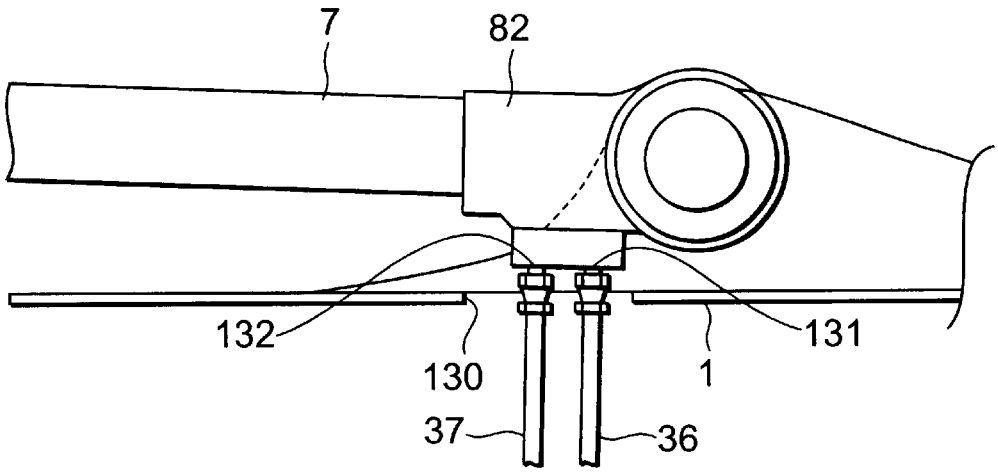
FIG. 11 is a schematic view of details of a portion D in FIG. 10.
Figure 12:
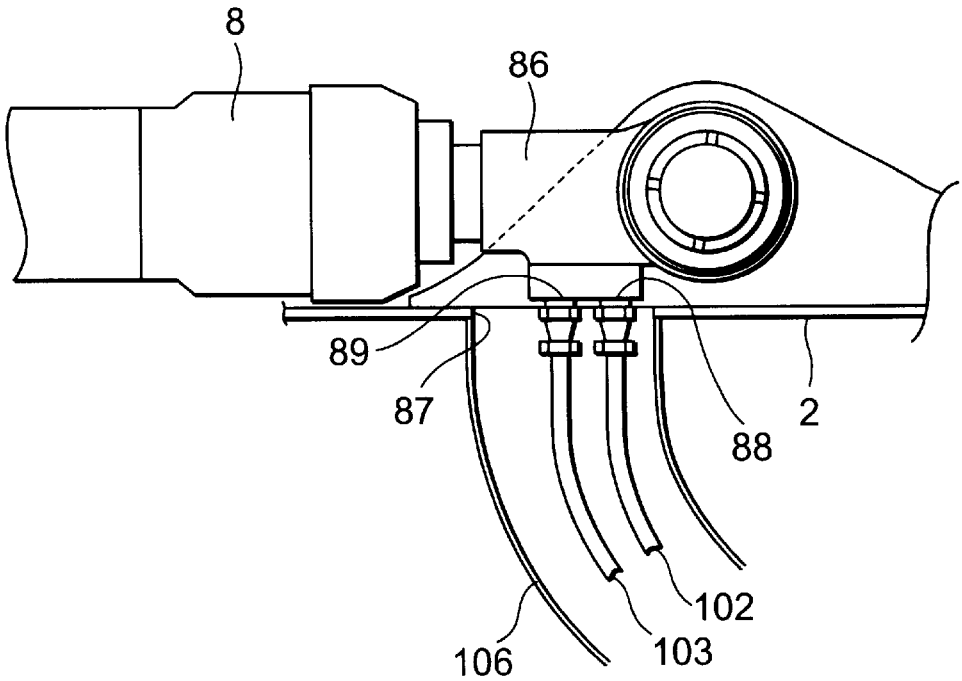
FIG. 12 is a schematic view of details of a portion E in FIG. 10.

FIGS. 11 and 12 are views of details of a portion D and a portion E in FIG. 10, that is, details of the upper surface M3 of the middle portion in the boom 1 and the upper surface M5 of the middle portion in the arm 2, respectively.

As shown in FIG. 11, an opening portion 130 through which the hose passes is provided on the upper surface of the boom 1 near the rod head 82 of the arm cylinder 7. The arm bottom hose 36 and the arm head hose 37 are connected to the bottom flow passage 131 and the head flow passage 132 pierced in the lower surface of the rod head 82 through the opening portion 130, respectively.

Further, as shown in FIG. 12, an opening portion 87 through which the hose passes is provided on the upper surface of the arm 2 near the rod head 86 of the bucket cylinder 8. The bucket bottom hose 102 and the bucket head hose 103 arranged in the inner portion of the hose guide 106 are connected to the bottom flow passage 88 and the head flow passage 89 pierced on the lower surface of the rod head 86 of the bucket cylinder 89, through the opening portion 87, respectively.

Next, a description will be given of operations and effects of the hydraulically driven type working machine having the structure mentioned above.

At first, a description will be given of an operation and an effect of the first swivel 28 in the base end portion of the boom 1 with reference to FIGS. 1 and 2. Five hoses comprising the bucket bottom hose, the bucket head hose, the arm bottom hose, the arm head hose and the drain hose except the hoses to the boom cylinders 6*a* and 6*b* are communicated with the front end portion of the boom via the first swivel 28 from the hydraulic power source of the base table 5. In the case that the first swivel 28 is not mounted as in the present embodiment, a lot of hoses are arranged in the base end portion of the boom with a large curvature. That is, since the boom 1 rotates at about 130 degrees with respect to the base table 5, it is necessary to arrange the hose on the safe side for the purpose of absorbing a working angle, and a large space is required for the purpose of arranging so that the hoses are not interfered with each other.

The bending portion of the hose is not required by passing a lot of hoses through the first swivel 28. Accordingly, since the hose is not exposed to the repeated bending around the base end portion of the boom, a service life of the hose is improved. Further, since the pipe arrangement is simplified and becomes compact, an assembling property of the pipe arrangement can be improved.

Further, the respective hoses 34, 35, 36, 37 and 38 arranged in the downstream side of the first swivel 28 are all built in the boom 1. However, in the conventional art, these hoses are all arranged along the upper surface or the side surface of the outer side of the boom 1. At this time, in many cases, a fixing seat is welded to the boom 1 for fixing a hydraulic steel pipe used for the unnecessary portion of the bending, however, there is a problem that a great stress is applied to a weld portion of the fixing seat and the weld portion becomes a starting point of a crack. In accordance with the present embodiment, since the fixing seat is not required, the crack is not generated and the boom 1 having an excellent reliability can be obtained.

Further, since the first swivel 28 is arranged between the base table left and right portions 13 and 14, utilizes the space of the boom base end portion and requires no surplus space for attaching the swivel, a compact working machine can be obtained. As in the swivel of the conventional working machine, the boom base end right shaft 11 also serving as the columnar joint can not sufficiently secure a strength required for a load supporting shaft, however, in accordance with the present embodiment, since the first columnar joint 28*a* is adhered to the boom base end right shaft 11 by the bolt 29, the boom base end right shaft 11 is structured such as to have a diameter with a strength sufficient to support the load of the boom 1. Due to the first swivel 28, the pipe arrangement is simplified, and the assembling property of the pipe arrangement is improved. Further, since the pipe arrangement is not exposed, an appearance is improved.

Figure 9:
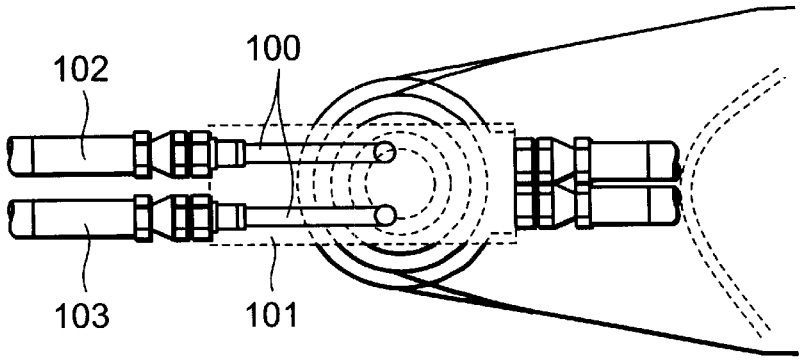
FIG. 9 is a view as seen from an arrow K in FIG. 8.

Next, a description will be given of an operation and an effect of the third swivel 98 in the front end portion of the boom 1 with reference to FIGS. 8 and 9.

The hoses 102 and 103 to the bucket bottom and the bucket head from the first swivel 28 are communicated with the bucket cylinder 8 via the third swivel 98. In the case that the third swivel 98 is not mounted as in the present embodiment, these two hoses are arranged through the outer portion of the front end portion in the boom 1 with a great curvature. That is, since the arm 2 rotates at about 145 degrees with respect to the boom 1, it is necessary to arrange the hose on the safety side so as to absorb the working angle, so that the hose is arranged so as to bypass the position faraway from the front end portion of the boom 1. Since the bending portion of the hose is not required by passing these pipe arrangements through the third swivel 98, the hose can pass through the front end portion of the boom 1 and the inner portion of the arm 2.

Accordingly, since the hoses are not exposed to the front end portion of the boom 1 which is easily close to the obstacle such as an electric wire, a ceiling of a tunnel and the like during the operation, the hoses are not interfered with the obstacle so as to be damaged.

Further, since the third swivel 98 is arranged between the arm base end left and right shafts 90 and 90*a* supported by the boom front end left and right portions 91 and 91*a*, utilizes the space of the arm base end portion and requires no surplus space for attaching the swivel, a compact working machine can be obtained. The flow passages corresponding to the bucket bottom hose 34, the bucket head hose 35 and the drain hose 38 connected to the third cylindrical joint 98*b* are extended to the pipe arrangement block 101 extended to the third columnar joint 98*a* via the flow passage 99 within the third columnar joint 98*a*. The flow passages are provided in the pipe arrangement block 101 so that the bucket bottom hose 102 and the bucket head hose 103 are directed to the front end of the arm 2. Accordingly, it is unnecessary to arrange the hose in the inner portion of the arm 2, and an operability of the pipe arrangement is improved.

Next, as shown in FIG. 4, since the second swivel 71 arranged in the left portion of the right boom cylinder base end shaft 50*a* and the second left swivel 81 arranged in the right portion of the left boom cylinder base end shaft 50 are arranged between the left and right boom cylinder base end shafts 50 and 50*a*, it is possible to obtain the compact second left and right swivels 71 and 81 using the space of the boom base end portion. Further, the second right swivel 71 has the same flow passage as that of the third swivel 98, and the flow passage is provided in the pipe arrangement block 74*a* so as to be directed to the left end surface of the rod 52*a* in the right boom cylinder 6*a*. Accordingly, the pipe arrangement to the right boom cylinder 6*a* is not required. On the contrary, the second left swivel 81 also has the same flow passage as that of the third swivel 98, and the flow passage is provided in the pipe arrangement block 74*b* so as to be directed to the right end surface of the rod 52*b* in the left boom cylinder 6*b*. Accordingly, the pipe arrangement to the left boom cylinder 6*b* is nor required.

Due to the third swivel 98 and the second left and right swivels 81 and 71 mentioned above, the pipe arrangement is simplified and an assembling property of the pipe arrangement is improved. Further, since the pipe arrangement is not exposed, an appearance is improved.

In this case, a description will be given of an operation and an effect of the drop preventing valve 200 with reference to FIG. 7.

When the oil pressure is supplied to the ascending pressure receiving portion 204, the position a is operated, and the oil is supplied to the bottom flow passage 70 via the second right swivel 71, the oil passage 73 and the check valve 210. Then, the hollow rod 62 is extended and the boom 1 mounted to the cylinder tube 60 ascends. On the contrary, when the oil pressure is supplied to the descending pressure receiving portion 205, the position c is operated and the oil is supplied to the head flow passage 69 via the second right swivel 71 and the oil passage 73. Then, the hollow rod 62 is compressed, and the boom 1 mounted to the cylinder tube 60 descends. At this time, since the oil pressure applied to the descending pressure receiving portion 205 is also supplied to the switching pressure receiving portion 211, the position e of the switching valve 208 is operated. Since the oil discharged from the bottom flow passage 70 returns to the tank 202 through the throttle 213, a descending speed of the boom 1 is never equal to or more than a predetermined value.

When taking out the second right swivel 71 for maintenance, the oil pressure of the pilot pressure passage 206 becomes 0, so that the position d of the switching valve 208 is operated. The hollow rod 62 is going to move in a compressing backward direction due to an empty weight of the boom 1, whereby the oil pressure of the bottom flow passage 70 is increased, however, since the portion between the ports P6 and P5 is shut off and the flow from the port P6 to the port P5 is stopped by the check valve 210, the boom 1 does not drop down. Further, even in the case that the hydraulic hose between the flow amount control valve 203 and the second right swivel 71 is burst, the boom 1 does not drop down.

Next, a description will be given of an operation and an effect of the arm cylinder 7 and the bucket cylinder 8 of the pipe arrangement built-in type with reference to FIGS. 11 and 12.

The arm cylinder 7 and the bucket cylinder 8 use the pipe arrangement built-in type cylinder which feeds the oil from the head flow passages 132 and 89 and the bottom flow passages 131 and 88 provided in the respective rod heads 82 and 86 to the head chamber and the bottom chamber. Accordingly, since the pipe arrangement to the hydraulic cylinder is not exposed to the external portion, the hose is not interfered with the obstacle so as to be broken.

Further, since the respective rod head sides of both of the cylinders 7 and 8 are arranged at the positions close to the base end portions of the boom 1 and the arm 2, in the arm cylinder 7, the obstacle such as the electric wire, the ceiling of the tunnel of the like is not interfered with the rod during the working, so that it is possible to prevent the rod from being broken. In the bucket cylinder 8, since the rod is not in contact with the earth in the excavated place by a cutting edge of the bucket 3, it is possible to prevent the rod from being broken in the same manner as that of the arm cylinder 7.

Figure 13:
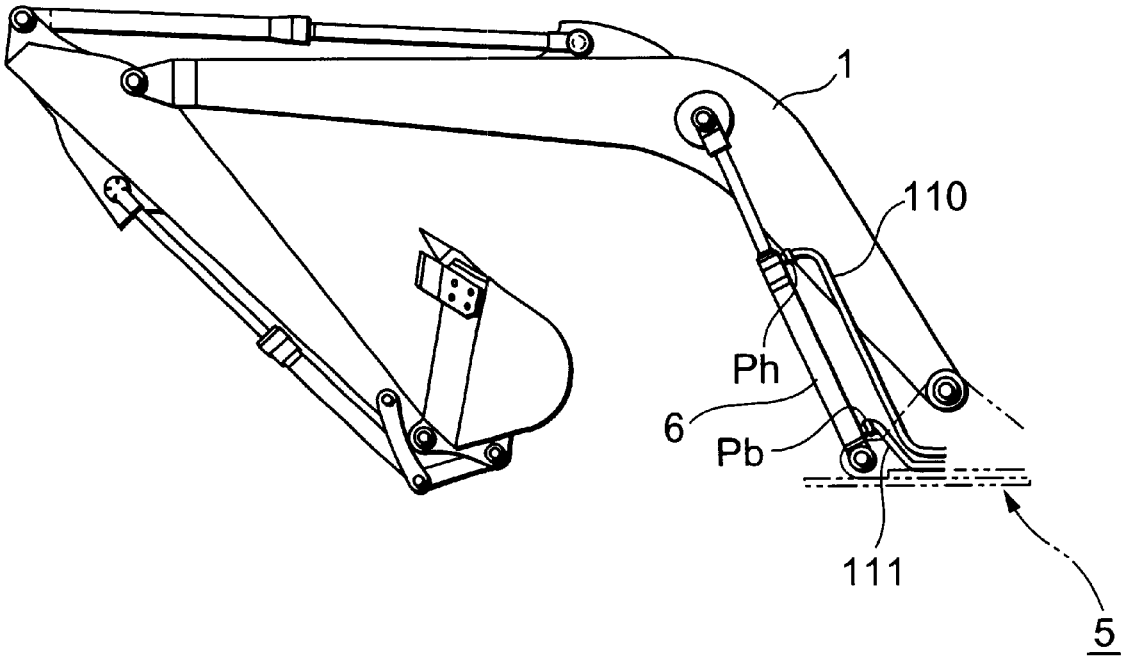
FIG. 13 is a schematic view of a hydraulic pipe arrangement of a boom cylinder in accordance with an applied embodiment of the present embodiment.

Here, in the present embodiment, as the boom cylinder 6, there is used the pipe arrangement built-in type cylinder supplying the oil from the front end of the rod to the bottom chamber and the head chamber, and the pipe arrangement is executed at the rod front end via the first swivel 28, however, as in an applied embodiment shown in FIG. 13, the conventional type cylinder may be mounted. That is, the oil is fed to the head chamber and the bottom chamber from a port Ph and a port Pb, and the respective ports Ph and Pb and the hydraulic power source of the base table 5 are directly connected by the pipe arrangements 110 and 111. When using the swivel and the pipe arrangement built-in type cylinder, it is possible to build in the hydraulic pipe arrangement within the cylinder, however, since the attaching position of the boom cylinder 6 is the portion where the obstacle is interfered with the pipe arrangement at a reduced possibility, it possible to use the conventional type cylinder.

Further, in accordance with the present embodiment, since the rotational angle of the arm cylinder 7 and the bucket cylinder 8 around the portions M3 and M5 in the side of the rod head is small about 10 degrees, the swivel is not used, however, in the case of the working machine in which the rotational angle is increased, the swivel may be used at the portions M4 and M5.

Further, in the present embodiment, the description is given of the embodiment in which the drop preventing valve 200 is mounted to the second left and right swivel portions 71 and 81, however, the drop preventing valve 200 may be also mounted to the first swivel 28 portion and the third swivel 98 portion. The flow passage is shut out at the position d of the switching valve 208 in the drop preventing valve 200, however, a throttle may be provided. The description is given of the embodiment of shutting off the flow passage of the oil which is going to be discharged from the bottom flow passage 70 at a time when the boom 1 is going to drop down, however, the flow passage of the oil which is going to flow in from the head flow passage 69.

As mentioned above, in accordance with the present invention, in the hydraulically driven type working machine having the members such as the boom 1, the arm 7, the bucket 8 and the like connected onto the base table 5 and driven by the hydraulic actuator, the hydraulic swivel joints are provided in the connecting portion between the base table 5 and the boom 1, the connecting portion between the boom 7 and the arm 8, and the connecting portion between the boom driving actuator and the base table 5. Accordingly, it is possible to build in the hoses arranged on the safe side along the outer portions of the respective connecting portions with a great curvature within the respective members without arrangement. Accordingly, since the working machine having a good appearance can be obtained and the bending of the hose is lost, a service life of the hose is improved. Further, since the hose is not exposed, the hose is not interfered with the obstacle, whereby the hose is not damaged.

Further, as the hydraulic actuator, there is used the pipe arrangement built-in type cylinder feeding the oil to the head chamber and the rod chamber from the head flow passage and the bottom flow passage pierced in the rod head, and the rod head side is mounted to be close to the base table 5, so that the rod is not in contact with the obstacle such as the electric wire, the ceiling in an underground construction, a wall of an excavating hole and the like. Accordingly, the rod of the hydraulic cylinder is not damaged.

Further, since the hydraulic swivel joints are arranged in the right and left branched spaces in the base end portions of the base table 5, the boom 1 and the arm 7, no surplus space for arranging the hydraulic swivel joints is required. Accordingly, a compact working machine can be obtained.

What is claimed is:

1. A hydraulically driven type working machine comprising:

a boom having a vertical swing supporting point supported at a base end side by a machine frame and a joint connection supporting point in a front end side;

an arm connected in a base end side to the joint connection supporting point of the boom;

a boom driving hydraulic cylinder hoisting around a hoist supporting point provided in the machine frame so as to drive the boom;

an arm driving hydraulic cylinder driving the arm; and a working tool driving hydraulic cylinder driving a working tool mounted to an arm front end side, wherein a swivel joint mechanism for relaying a hydraulic pipe arrangement from a side of said machine frame is provided at a center of at least one of said vertical swing supporting point, said joint connection supporting point and said boom driving hydraulic cylinder hoist supporting point.

2. A hydraulically driven type working machine as claimed in claim 1, wherein said swivel joint mechanism has one side hose joint connected to said machine frame side and another side hose joint connected to said hydraulic cylinder side, and a hydraulic valve for shutting off at least one of a plurality of oil passages communicated another side hose joint with the hydraulic cylinder or restricting an area of the oil passages is provided in the oil passages.

3. A hydraulically driven type working machine as claimed in claim 1, wherein said swivel joint mechanism at the center of said vertical swing supporting point of the boom is arranged between left and right divided supporting shaft pins of a forked boom swing supporting shaft portion, and is provided with one side hose joint of a pipe arrangement rotary joint concentric with a center of the supporting shaft pins connected to said machine frame side and another side hose joint connected to said boom side.

4. A hydraulically driven type working machine as claimed in claim 3, wherein one side supporting shaft pin of the left and the right divided supporting shaft pins in said boom swing supporting shaft portion has a connection flow passage connecting the machine frame side pipe arrangement to said swivel joint mechanism, said one side hose joint is a columnar joint having a pipe arrangement joint flow passage in the side of the machine frame mounted to an axial direction of the one side supporting shaft pin, said another side hose joint is a cylindrical joint fitted to the columnar joint and provided with a plurality of inner circumferential annular grooves communicated with the pipe arrangement joint flow passage of the columnar joint and respective through holes communicated with these inner circumferential annular grooves, a boom built-in pipe arrangement is mounted to the cylindrical joint, and the swivel joint mechanism is connected to the boom so that the cylindrical joint rotates together with the swing motion of said boom.

5. A hydraulically driven type working machine as claimed in claim 1, wherein the swivel joint mechanism at the center of said joint connection supporting point of the arm is arranged between left and right divided supporting shaft pins of a forked arm joint connection supporting shaft portion, and is provided with one side hose joint of a pipe arrangement rotary joint concentric with a center of the supporting shaft pins connected to said boom side and another side hose joint connected to said arm side.

6. A hydraulically driven type working machine as claimed in claim 5, wherein the another side hose joint of the swivel joint mechanism at the center of said arm joint connection supporting point is constituted by a joint in which a pipe arrangement block and a columnar joint concentric with the center of said supporting shaft pin are integrally formed in an L shape so as to form an interior communication flow passage extending from the columnar joint to the pipe arrangement block, said one side hose joint is constituted by a cylindrical joint fitted to the columnar joint and provided with a plurality of inner circumferential annular grooves communicated with the interior communication flow passage and respective through holes communicated with these inner circumferential annular grooves, the cylindrical joint is connected to said boom side so as to form a connection joint of a boom built-in pipe arrangement, and the pipe arrangement block is mounted to said arm side so as to form a connection joint of an arm built-in pipe arrangement.

7. A hydraulically driven type working machine as claimed in claim 1, wherein the swivel joint mechanism at the center of said boom driving hydraulic cylinder hoist supporting point is arranged close by a supporting shaft pin which is the hoist supporting point of the boom driving hydraulic cylinder, and is provided with one side hose joint of a pipe arrangement rotary joint concentric with a center of the supporting shaft pin connected to said machine frame side and another side hose joint connected to said boom driving hydraulic cylinder side.

8. A hydraulically driven type working machine as claimed in claim 7, wherein the another side hose joint of the swivel joint mechanism at the center of said boom driving hydraulic cylinder hoist supporting point is constituted by a joint in which a pipe arrangement block and a columnar joint concentric with the center of said supporting shaft pin are integrally formed in an L shape so as to form an interior communication flow passage extending from the columnar joint to the pipe arrangement block, said one side hose joint is constituted by a cylindrical joint fitted to the columnar joint and provided with a plurality of inner circumferential annular grooves communicated with the interior communication flow passage and respective through holes communicated with these inner circumferential annular grooves, the cylindrical joint is connected to said machine frame side so as to form a connection joint of a machine frame side pipe arrangement, and the pipe arrangement block is formed as a connection joint of a boom driving hydraulic cylinder side pipe arrangement.

9. A hydraulically driven type working machine comprising:

a boom driving hydraulic cylinder, an arm driving hydraulic cylinder and a working tool driving hydraulic cylinder are formed as hydraulic cylinders respectively having communication passages supplying and discharging a working oil fluid from inner portions of respective piston rods to head side oil chambers and bottom side oil chambers in piston chambers within respective cylinders, respective cylinders sides of the driving hydraulic cylinders are respectively connected to the boom, the arm and the working tool side so as to form longitudinally moving bodies, and respective piston rod sides are respectively arranged so as to form hoist supporting points by supporting shaft pins via supporting brackets provided in the machine frame, the boom and the arm side, wherein said hydraulically driven type working machine is provided with a first swivel joint mechanism mounting a boom built-in pipe arrangement to a cylindrical joint and connected to the boom so that the cylindrical joint rotates together with a swing motion of said boom, a third swivel joint mechanism connecting a cylindrical joint to said boom side so as to form a connection joint of a boom built-in pipe arrangement and setting a pipe arrangement block and a columnar joint integrally mounted to said arm side to a connection joint of an arm built-in pipe arrangement, and a second swivel joint mechanism connecting a cylindrical joint to said machine frame side so as to form a connection joint of a machine frame side pipe arrangement and setting a pipe arrangement block and a columnar joint to a connection joint of a boom driving hydraulic cylinder side pipe arrangement, in the hydraulic pipe arrangement to said arm driving hydraulic cylinder, the boom built-in pipe arrangement extending via the first swivel joint mechanism is connected to a front end portion of the piston rod in the arm driving hydraulic cylinder, in the hydraulic pipe arrangement to said working tool driving hydraulic cylinder, the arm built-in pipe arrangement extending via the third swivel joint mechanism is connected to a front end portion of the piston rod in the working tool hydraulic cylinder, and in the hydraulic pipe arrangement to said boom driving hydraulic cylinder, the pipe arrangement block and the columnar joint of the second swivel joint mechanism are integrally connected to the piston rod of the boom driving hydraulic cylinder, whereby the respective hydraulic pipe arrangement to the driving hydraulic cylinders are not exposed to an external portion.

* * * * *

UNITED STATES PATENT AND TRADEMARK OFFICE

CERTIFICATE OF CORRECTION

PATENT NO. : 6,578,296 B2
DATED : June 17, 2003
INVENTOR(S) : Kimoto et al.

It is certified that error appears in the above-identified patent and that said Letters Patent is hereby corrected as shown below:

Title page,
Change Item "[73] Assignee: Komatsu Ltd., Tokyo (JP)" to
-- [73] Assignee: Komatsu Ltd., Tokyo (JP); Komatsu Zenoah Co., Kawagoe-shi (JP) --

Signed and Sealed this

Twenty-third Day of September, 2003

JAMES E. ROGAN
*Director of the United States Patent and Trademark Office*